United States Patent [19]

Blough

[11] Patent Number: 4,538,512

[45] Date of Patent: Sep. 3, 1985

[54] REFUSE RECEPTACLE WITH LIQUID RETAINER

[76] Inventor: James A. Blough, 308 East Smith St., Hesston, Kans. 67062

[21] Appl. No.: 602,556

[22] Filed: Apr. 20, 1984

[51] Int. Cl.[3] ..... B30B 9/02

[52] U.S. Cl. ..... 100/131; 100/229 A; 220/1.5; 220/1 T; 220/DIG. 5; 414/525 R

[58] Field of Search ..... 100/229 A, 131, 132, 100/104, 116; 220/1.5, 1 T, DIG. 5; 414/525 R

[56] References Cited

U.S. PATENT DOCUMENTS

| | | | |
|---|---|---|---|
| 3,229,622 | 1/1966 | French | 100/229 A |
| 3,662,910 | 5/1972 | Herpich | 100/229 A |
| 3,724,713 | 4/1973 | Coren | 100/229 A |
| 4,464,987 | 8/1984 | Heinrich | 100/229 A |
| 4,482,283 | 11/1984 | Froderberg | 414/525 R X |

FOREIGN PATENT DOCUMENTS

| | | | |
|---|---|---|---|
| 18262 | 2/1978 | Japan | 100/229 A |
| 7411420 | 3/1976 | Netherlands | 220/1.5 |
| 2087790 | 6/1982 | United Kingdom | 100/229 A |

*Primary Examiner*—Billy J. Wilhite

*Attorney, Agent, or Firm*—Kokjer, Kircher, Bradley, Wharton, Bowman & Johnson

[57] ABSTRACT

A trash container has a collecting trough for receiving and retaining liquid and solid spillage The trough is secured to the front wall of the trash container immediately below an opening through which refuse is deposited from a trash compactor. Liquid spillage drains into the trough rather than onto the ground to create a mess. Solid spillage is caught and retained by the trough when the container is separated from the compactor. In a modified form of the invention, a barrier extends along the sides of the opening and above it to prevent liuqid from running along the front wall of the trash container when it is inverted for dumping of its contents.

10 Claims, 5 Drawing Figures

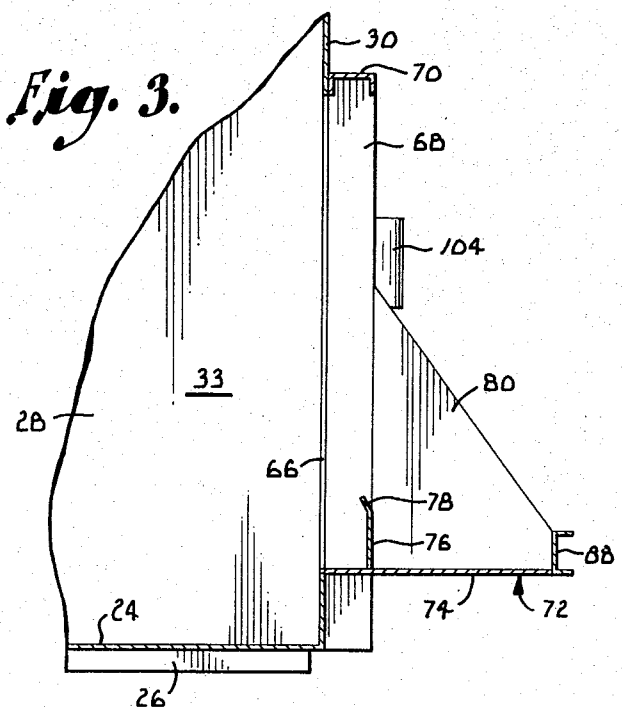
Fig. 3.
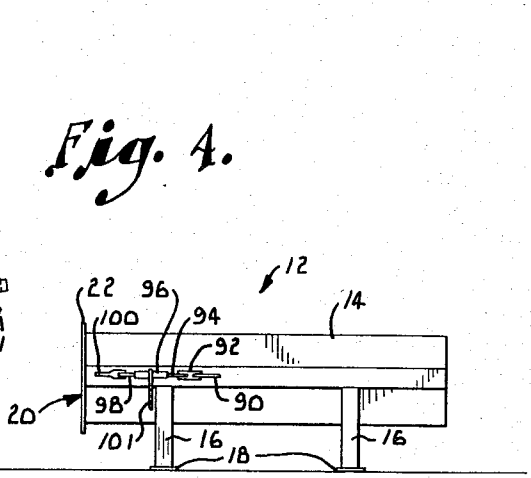
Fig. 4.
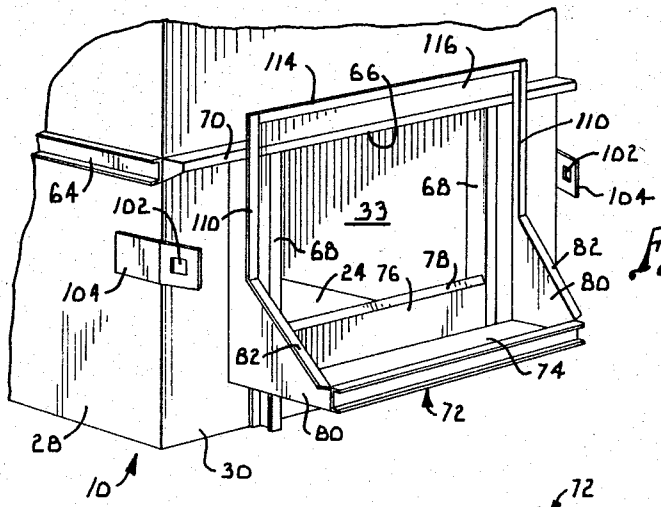
Fig. 5.
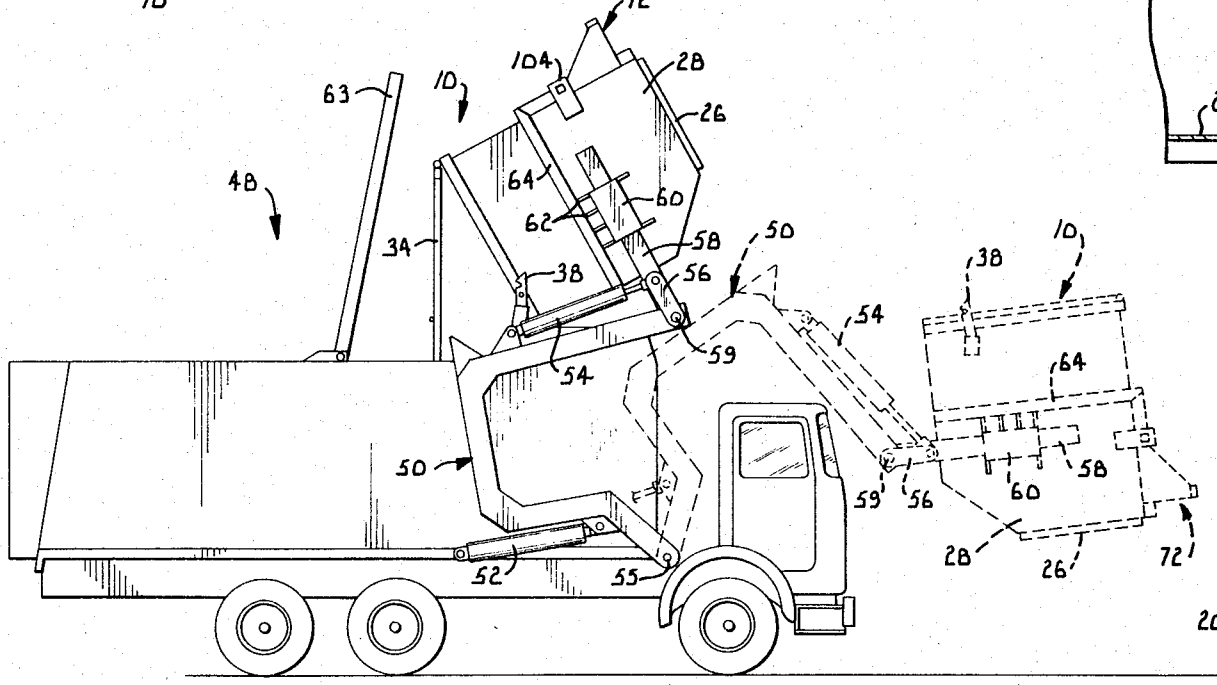

REFUSE RECEPTACLE WITH LIQUID RETAINER

BACKGROUND AND SUMMARY OF THE INVENTION

This invention relates generally to the field of refuse handling and more particularly to a trash container having a trough for receiving and collecting liquid spillage.

In the refuse handling industry, it is common for trash compactors to be used by businesses that generate large volumes of trash. The trash is delivered to the compactor by a delivery chute or another type of conveyor. A ram in the trash compactor is used to compress the refuse and transfer it into a large trash container through an opening in the front wall of the container. The trash container is unloaded by a collection truck having a hydraulic lift mechanism which lifts the trash receptacle and dumps its contents into the truck body.

Although this type of trash collection system handles large amounts of refuse in a generally efficient manner, it is not entirely satisfactory in all respects. One of the most notable problems results from the liquid spillage that inevitably results when the refuse is transferred from the trash compactor into the trash container. Although these two units are coupled together and are normally pulled snuggly against one another, the garbage compression causes liquids to be squeezed out of the garbage, and some of the liquid invariably leaks between the compactor and container. The liquid spillage runs along the front wall of the trash container and creates unsightly and malodorous messes on the ground, on the outside of the trash container, and on the garbage collection truck.

Additionally, when the container is separated from the compactor for dumping the contents into the collection truck, some of the compressed contents in the container have a tendency to fall out through the container opening. This solid material spillage adds to the mess from the liquid spillage and increases the problem at the trash collection site.

In accordance with the present invention, an improved refuse container is provided with a trough which serves as a liquid collector to catch and retain liquid spillage and also any solid spillage which may occur, thus eliminating the messes that have been created in the past.

It is an object of the invention to provide a trash container having a trough which is constructed and located to receive liquid that spills when refuse is transferred into the trash container through an opening in its front wall and also to catch such solids as may tend to spill from the container when the latter is separated from the compactor.

Another object of the invention is to provide a trash container in which the collection trough does not interfere with the transfer of refuse or other functions of the trash container or trash compactor.

Still another object of the invention is to provide a spillage collection trough which is well suited for use on trash compactors having various sizes and styles.

A further object of the invention is to provide a collection trough which is economical to construct and which can be added onto existing trash containers as well as incorporated in newly built containers.

An additional object of the invention is to provide a trash container which is equipped with a spillage collection trough along with a cooperating lip structure which serves as a barrier preventing liquid from draining out of the trough and along the container wall when the trash container is inverted for dumping of its contents.

Other and further objects of the invention, together with the features of novelty appurtenant thereto, will appear in the course of the following description.

DETAILED DESCRIPTION OF THE INVENTION

In the accompanying drawings which form a part of the specification and are to be read in conjunction therewith and in which like reference numerals are used to indicate like parts in the various views:

FIG. 3 is a fragmentary sectional view on an enlarged scale taken generally alone line 3—3 of FIG. 1 in the direction of the arrows;

FIG. 4 is a side elevational view showing the trash container being lifted and dumped into a trash collection truck;

FIG. 5 is a fragmentary perspective view showing a trash container equipped with a spillage collection trough and with a retaining lip forming a barrier which inhibits liquid drainage when the container is inverted.

Figure 1:
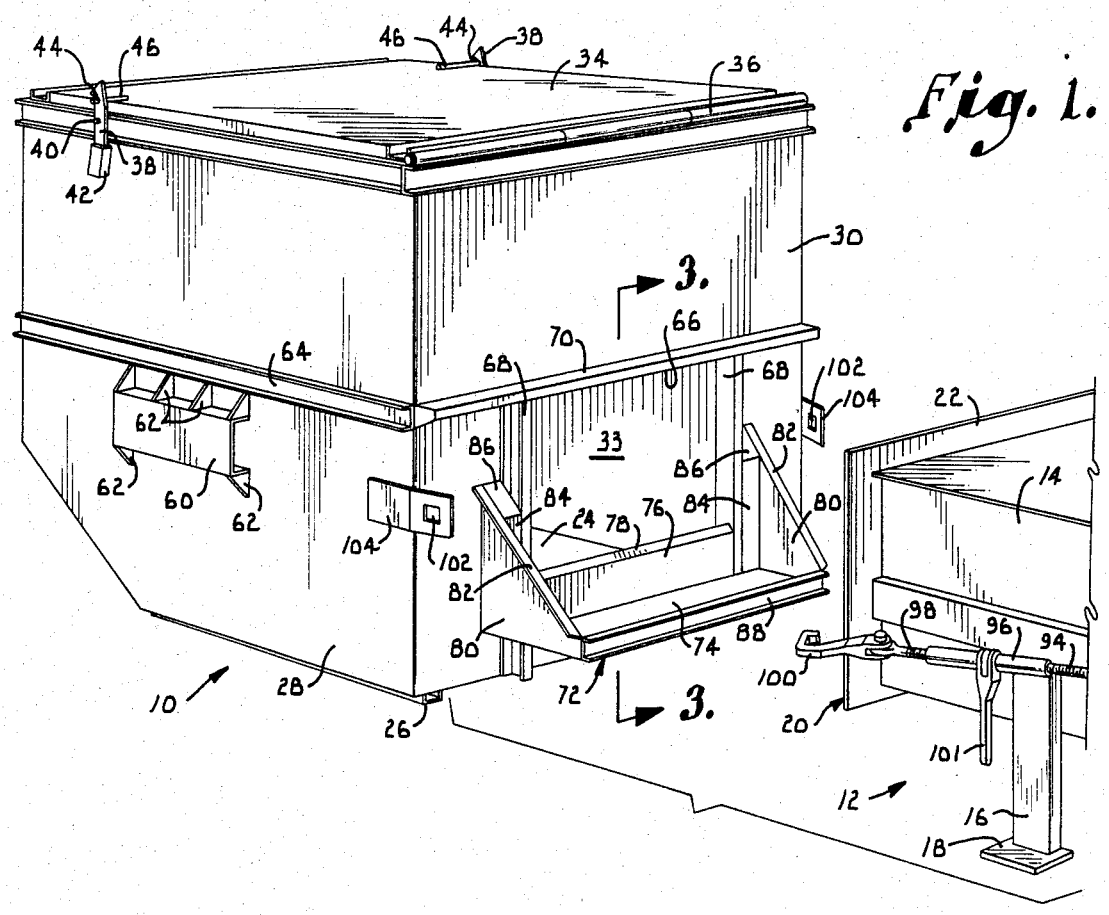
FIG. 1 is a perspective view of a trash container equipped with a spillage collection trough in accordance with the present invention, with a trash compactor spaced from the trash container and shown only fragmentarily.

Referring now to the drawings in more detail, numeral 10 generally designates a box-like trash receptacle or container, and numeral 12 generally designates a horizontally oriented trash compactor which serves to compress refuse and transfer it into the trash container 10. The trash compactor 12 has a hollow body 14 supported on four vertical legs 16 having base plates 18 on their lower ends. The body 14 of the trash compactor has an open end 20 facing the trash container 10. The open end 20 is surrounded by a rim formed by a flange 22 which lies in a vertical plane.

The trash container 10 is a box-like structure having a horizontal floor 24 supported on a pair of elongate feed 26 formed by inverted channels. Extending upwardly from the floor 24 are parallel side walls 28, a front wall 30 and a back wall 32. The walls cooperate to provide an enclosed space 33 within the container for receiving and holding refuse.

The top of trash container 10 is opened and closed by a lid 34 which is connected with the top edge of the front wall 30 by a horizontal hinge 36. A pair of gravity latches 38 are pivotally mounted to the side walls 28 by pins 40. The lower end of each latch 38 carries a weight 42, and each latch 38 has a notch 44 near its top end. The notches 44 receive pins 46 which project from the opposite sides of the lid, and the latches then hold the lid down in its closed position covering the top of the trash container. When the trash container 10 is tilted to the rear, the weights 42 cause latches 38 to automatically release, and the lid 34 opens about the hinge 36 so that the contents of the trash container can be unloaded.

As best shown in FIG. 4, the trash container is unloaded into a garbage collection truck 48 having a hydraulic lift 50 powered by cylinders 52 and 54. The lower cylinders 52 pivot the lift 50 as a whole up and down about a horizonal axis 55. The upper cylinders 54 are connected at their base ends with the lift 50 and at their rod ends with links 56 which act to pivot parallel lift arms 58 about pivot pins 59. The lift arms may be extended through channels 60 mounted on the opposite side walls 28 of the container. A plurality of gusset plates 62 reinforce each channel 60. The box on the collection truck 48 has a hinged lid 63 which accommodates dumping of refuse in to the truck.

A horizontal channel 64 is secured along each of the container side walls 28 immediately above the channel 60. The trash compactor 12 transfers refuse into container 10 through a rectangular opening 66 formed in the front wall 30 of the container. The opening 66 is bounded by a rigid frame secured to the outside surface of wall 30. The frame includes a pair of upright channels 68 each having one flange welded or otherwise secured to wall 30 such that the channels 68 extend along the opposite sides of opening 66. A cross member of the frame is formed by a horizontal channel 70 which extends along the upper edge of opening 66 and across the entire width of the front wall 30. Channel 70 opens downwardly and has one flange welded or otherwise secured to wall 30. Channel 70 extends between and beyond the upper ends of the upright channels 68.

In accordance with the present invention, a spillage collector is formed by a trough 72 which is secured to the front wall 30. The trough includes a horizontal bottom panel 74 having its back edge welded or otherwise secured to wall 30 along the lower edge of opening 66. The back of the trough is formed by a vertical back panel 76 which extends upwardly from the bottom panel 74. Panel 76 is secured to channels 68 at its opposite ends and, as best shown in FIG. 3, occupies the same plane as the front flanges of the channels 68. An inclined lip 78 extends upwardly and rearwardly from the upper edge of the back panel 76.

The opposite sides of the trough 72 are formed by parallel side panels 80 which are generally triangular. The lower edges of the side panels 80 are secured to the opposite ends of the floor panel 74, and the back edges of panels 80 are welded or otherwise secured to wall 30. Each side panel 80 has an outwardly turned flange 82 on its top edge. The side panels 80 are spaced outwardly somewhat from the upright channels 68 on opposite sides of opening 66. Vertical plates 84 extend between each side panel 80 and the adjacent channel 68. The upper portions 86 of plates 84 are bent to incline in conformity with the incline of the flanges 82.

A horizontal channel 88 provides a lip forming the front wall of the trough 72. Channel 88 is secured to the front edge of the bottom panel 74, and the opposite ends of the channel are secured to the side panels 80. The area above the bottom panel 74 between the side panels 80, the back panel 78 and the front channel 88 forms a pan for receiving and retaining spillage, as will be explained more fully.

Figure 2:
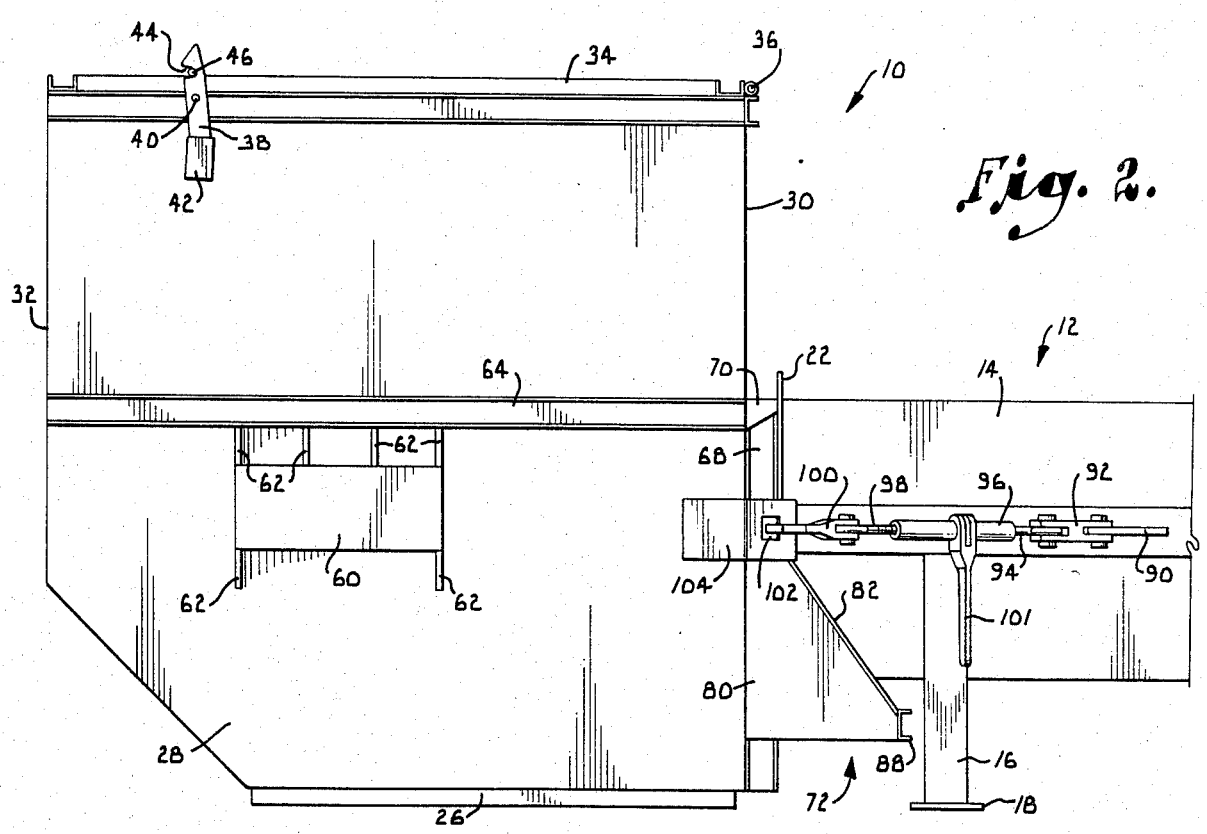
FIG. 2 is a side elevational view showing the trash compactor coupled to and pulled tightly against the trash container.

As best shown in FIGS. 1 and 2, each side of the trash compactor 12 is equipped with an ear plate 90 to which one end of a double clevis 92 is pivoted. A threaded rod 94 is pivoted to the other end of the clevis and is threaded into a sleeve 96 which forms a turnbuckle. Threaded into the opposite end of each sleeve 96 is another threaded rod 98. A hook 100 is pivotally carried on each rod 98. Each sleeve 96 is equipped with a handle 101 which facilitates tightening and loosening of the turnbuckle mechanism.

The hooks 100 can be fitted in openings 102 formed in projecting portions of plates 104 which are secured to the opposite side walls 28 of the trash container. When the hooks are hooked through the openings 102, the turnbuckle mechanisms can be tightened in order to pull the flange 22 on the open end of the trash compactor snuggly against the channels 68 and 70 and the panel 78 which border opening 66. This holds the open end of the trash compactor in registration with opening 66 and prevents trash from spilling as it is compacted and transferred into the trash container 10 from the compactor 12.

The trough 72 is located immediately below opening 66 and serves to collect and retain any liquid spillage resulting from the compaction and transfer of refuse. As the trash is compressed by the compactor, the liquid that is squeezed out invariably leaks at least in small quantities between the flange 22 and the panel 76. The underlying trough 72 receives the liquid spillage and prevents it from leaking onto the ground and creating an unsightly mess. The liquid which collects in the trough 72 tends to drain back into container 10 through opening 66 when the container is lifted and tilted to the rear for dumping of its contents, as shown in FIG. 4.

In addition to serving to catch and collect such liquids as may spill from the interconnected container and compactor assembly during the compacting operation, trough 72 also serves as a collector of solid waste during the container dumping operation. The compacted solid materials in the container have a tendency to force some of the material out the container opening when the container is separated from the compactor in order to dump the contents of the container into the collecting truck. Heretofore, such solid material spillage has been permitted to add to the liquid accumulated on the ground. Trough 72 is advantageously in position to catch such solid spillage, however, so that it is returned to the container along with the collected liquid spillage as has been heretofore explained.

FIG. 5 shows another form of the invention which for the most part is identical to the form shown in FIG. 1. The embodiment of FIG. 5 differs only in that it includes a lip or barrier which prevents liquid from draining out of the trough 72 and along the front wall 30 when the trash container is inverted or tilted in the manner shown in solid lines in FIG. 4. With reference to FIG. 5, the barrier includes a pair of vertical angles 110 which form lips on opposite sides of the opening 66. The angles 110 are essentially upward continuations or extensions of the side panels 80 and lips 82. The barrier also includes a horizontal angle 114 which extends horizontally between the upper ends of angles 110. Angle 114 is secured to wall 30 and forms a lip located above the channel 70 on the upper edge of opening 66. A flat plate 116 extends between the back edges of angles 110 and between the back edge of angle 114 and the forward flange of channel 70.

In use, the barrier formed by angles 110 and 114 prevents liquid collected in trough 72 from draining along wall 30 when the container is inverted or tilted for dumping. Any liquid which drains out of the trough is confined within the area defined by angles 110 and 114 and drains back into the trough when the trash container is lowered by the lift mechanism 50 on the collection truck 48.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having thus described the invention, I claim:

1. In a trash container having a wall presenting an opening for receiving refuse from a trash compactor having an open end adapted to register with the opening, the improvement comprising a spillage collector generally underlying said opening on the exterior of the trash container for receiving material spillage, said collector extending generally outwardly from said wall of the trash container and presenting a trough below the opening for receiving and retaining liquid that spills during transfer of refuse from the compactor into the container through said opening and solids that spill from said opening when the container is separated from the compactor, and means providing a lip extending from said trough and along said wall of the trash container on opposite sides of said opening and above said opening to inhibit drainage of liquid from the trough along said wall when the trash container is inverted.

2. A trash container for receiving refuse from a trash compactor having an open end, said trash container comprising:

a hollow receptacle having a plurality of generally vertical walls cooperating to define an enclosed space in the receptacle for receiving refuse;

an opening in one of said walls for receiving refuse transferred into said space by the trash compactor; and a liquid collector mounted on said one wall for receiving liquid spillage, said liquid collector extending generally outwardly from said one wall and being shaped and located to present a trough below said opening for receiving and retaining liquid that spills during transfer of refuse from the compactor into said receptacle through said opening, said liquid collector including a bottom panel extending generally outwardly from said one wall at a location underlying said opening to receive liquid spillage;

a pair of sides extending generally outwardly from said ofe wall on opposite sides of said opening to confine the liquid collected on said bottom panel; and a front lip projecting upwardly from said bottom panel at a location spaced outwardly from said one wall, said lip extending between said sides to confine the liquid collected on said bottom panel.

3. A trash container for receiving refuse from a trash compactor having an open end surrounded by a flange, said trash container comprising:

a hollow receptacle having a floor and a plurality of interconnected walls cooperating to present an enclosed space within the receptacle for receiving and holding refuse, one of said walls presenting an opening for receiving refuse from the trash compactor;

a lid on said receptacle mounted thereon to open and close and effective when open to expose said space from the top for unloading of refuse therefrom;

a rigid frame on the exterior of said one wall, said frame extending around said opening and presenting a contact surface for contact with the flange of the trash compactor;

a collector forming a trough on the exterior of said one wall beneath said opening to receive and retain liquid and solid spillage;

a bottom panel of said collector forming the bottom of the trough and extending outwardly from said one wall below said opening;

a pair of side panels of said collector forming the opposite sides of the trough and extending outwardly from said one wall with said bottom panel extending between said side panels; and a lip extending upwardly from said bottom panel and between said side panels to form the front of the trough.

4. The invention of claim 3, wherein said frame has a bottom cross member presenting a panel extending upwardly from said bottom panel to form the back of the trough.

5. The invention of claim 3, including:

a pair of lips extending from the respective side panels along said one wall of the receptacle on opposite sides of said opening; and a third lip extending along said one wall between the lips in said pair above said opening to cooperate with said pair of lips to form a barrier inhibiting drainage of liquid from the trough when said receptacle is inverted.

6. In a trash container having a wall presenting an opening for receiving refuse from a trash compactor having an open end adapted to register with the opening, the improvement comprising a spillage collector generally underlying said opening on the exterior of the trash container for receiving material spilage, said collector extending generally outwardly from said wall of the trash container and presenting a trough below the opening for receiving and retaining liquid that spills during transfer of refuse from the compactor into the container through said opening and solids that spill from said opening when the container is separated from the compactor, said spillage collector including a bottom panel extending outwardly from said wall at a location below the opening to receive liquid spillage, a pair of sides extending generally outwardly from said wall on opposite sides of the opening, said sides connecting with said bottom panel to confine the liquid collected thereon, a pair of lips extending from the respective sides of the spillage collector along said wall of the trash container on opposite sides of said opening, and a third lip extending between the lips in said first pair along said wall of the trash container above said opening, said lips cooperating to inhibit drainage of liquid from the trough along said wall when the trash container is inverted.

7. A trash container for receiving refuse from a trash compactor having an open end, said trash container comprising:

a hollow receptacle having a plurality of generally vertical walls cooperating to define an enclosed space in the receptacle for receiving refuse;

an opening in one of said walls for receiving refuse transferred into said space by the trash compactor; and a liquid collector mounted on said one wall for receiving liquid spillage, said liquid collector extending generally outwardly from said one wall and being shaped and located to present a trough below said opening for receiving and retaining liquid that spills during transfer of refuse from the compactor into said receptacle through said opening, the latter being generally rectangular and including opposite side edges, a top edge and a bottom edge, said opening being bounded by a pair of rigid uprights secured to said one wall in extension generally along said side edges of the opening and top and bottom cross members extending between said uprights in extension generally along the respective top and bottom edges of the opening, said uprights and cross members forming contact surfaces for engagement with the open end of the trash compactor, said bottom cross member presenting a panel forming a back portion of said trough.

8. The invention of claim 7, wherein said liquid collector includes:

a bottom panel extending from said one wall at a location below said bottom cross member to receive liquid spillage;

a pair of sides extending from said one wall at locations outwardly of said uprights, said sides being connected with said bottom panel to retain liquid thereon; and a front lip on said bottom panel projecting upwardly therefrom at a location spaced from said one wall to assist in retaining liquid on said bottom panel.

9. The invention of claim 8, wherein said bottom cross member presents a panel connected with said bottom panel to form a back wall of said trough.

10. A trash container for receiving refuse from a trash compactor having an open end, said trash container comprising:

a hollow receptacle having a plurality of generally vertical walls cooperating to define an enclosed space in the receptacle for receiving refuse;

an opening in one of said walls for receiving refuse transferred into said space by the trash compactor; and a liquid collector mounted on said one wall for receiving liquid spillage, said liquid collector extending generally outwardly from said one wall and being shaped and located to present a trough below said opening for receiving and retaining liquid that spills during transfer of refuse from the compactor into said receptacle through said opening, said trough being formed by a bottom panel extending outwardly from said one wall at a location below said opening, a pair of sides extending from said one wall on opposite sides of said opening and a front lip on said bottom panel;

a pair of lips extending from the respective sides of the trough along said one wall on opposite sides of said opening; and a third lip extending along said one wall between the lips of said pair above said opening to cooperate with said pair of lips to provide a barrier inhibiting drainage of liquid from the trough along said one wall when said receptacle is inverted.

* * * * *